US011751668B2

(12) United States Patent
Guo et al.

(10) Patent No.: US 11,751,668 B2
(45) Date of Patent: Sep. 12, 2023

(54) BABY HAMMOCK AND BABY CRIB

(71) Applicant: WONDERLAND SWITZERLAND AG, Steinhausen (CH)

(72) Inventors: Zhengwen Guo, Steinhausen (CH); Wuqing Liu, Steinhausen (CH); Huan Ning, Steinhausen (CH)

(73) Assignee: WONDERLAND SWITZERLAND AG, Steinhausen (CH)

( * ) Notice: Subject to any disclaimer, the term of this patent is extended or adjusted under 35 U.S.C. 154(b) by 0 days.

(21) Appl. No.: 17/576,050

(22) Filed: Jan. 14, 2022

(65) Prior Publication Data

US 2022/0225788 A1 Jul. 21, 2022

(30) Foreign Application Priority Data

Jan. 15, 2021 (CN) ..... 202110057261.7

(51) Int. Cl.

| | |
|---|---|
| ***A47D 7/04*** | (2006.01) |
| ***A47D 7/00*** | (2006.01) |
| ***A47D 13/06*** | (2006.01) |
| ***A45F 3/22*** | (2006.01) |
| *A47D 9/00* | (2006.01) |

(52) U.S. Cl.

CPC ..... *A47D 7/04* (2013.01); *A47D 7/002* (2013.01); *A45F 3/22* (2013.01); *A47D 9/005* (2013.01); *A47D 13/063* (2013.01)

(58) Field of Classification Search

CPC . A47D 7/04; A47D 7/002; A47D 7/00; A47D 9/00; A47D 9/005; A47D 13/06; A47D 13/061; A47D 13/063; A47D 13/066; A47D 15/00; A47D 15/001; A47D 15/003; A45F 3/22; A45F 3/24

USPC ..... 5/93.1, 93.2, 97, 98.1, 98.3, 99.1

See application file for complete search history.

(56) References Cited

U.S. PATENT DOCUMENTS

| | | | | |
|---|---|---|---|---|
| 6,131,218 | A * | 10/2000 | Wang | A47D 13/06 5/98.1 |
| 7,013,505 | B2 * | 3/2006 | Martin | A47D 7/02 5/98.1 |
| 7,739,759 | B2 * | 6/2010 | Mendes | A47D 7/04 5/655 |
| 7,752,693 | B2 * | 7/2010 | Espenshade | A47D 13/063 5/655 |

(Continued)

FOREIGN PATENT DOCUMENTS

| | | |
|---|---|---|
| CN | 101297726 A | 11/2008 |
| CN | 201332886 Y | 10/2009 |

(Continued)

OTHER PUBLICATIONS

Office Action issued in counterpart Taiwanese Patent Application No. 111101703, dated Feb. 13, 2023.

*Primary Examiner* — Robert G Santos
(74) *Attorney, Agent, or Firm* — Volpe Koenig

(57) ABSTRACT

A baby hammock is provided including: a crib support; a first peripheral crib fence mounted to the crib support and having an opening at a bottom thereof; and a hammock portion, where a periphery of the hammock portion is detachably connected to the first peripheral crib fence by at least one first zipper, and the hammock portion covers the opening of the first peripheral crib fence. A baby crib including the above baby hammock is also provided.

27 Claims, 8 Drawing Sheets

(56) References Cited

U.S. PATENT DOCUMENTS

| | | | | |
|---|---|---|---|---|
| 7,882,579 | B2 * | 2/2011 | Jackson | A47D 7/04 5/98.1 |
| 8,001,630 | B2 * | 8/2011 | Burkholder | A47D 7/04 5/98.1 |
| 8,141,186 | B2 * | 3/2012 | Burns | A47D 13/063 5/98.1 |
| 8,201,291 | B2 * | 6/2012 | Burns | A47D 13/063 5/98.1 |
| 8,291,530 | B2 * | 10/2012 | Burkholder | A47D 7/04 5/98.1 |
| 8,566,988 | B2 * | 10/2013 | Son | A47D 9/00 5/99.1 |
| 8,806,673 | B2 * | 8/2014 | Burkholder | A47D 9/00 5/98.1 |
| 9,345,339 | B2 * | 5/2016 | Wang | A47D 9/005 |
| 9,351,586 | B2 * | 5/2016 | Burkholder | A47D 9/00 |
| 9,763,523 | B2 * | 9/2017 | Thomson | A47D 7/005 |
| 9,901,187 | B2 * | 2/2018 | Burkholder | A47D 9/005 |
| RE48,148 | E * | 8/2020 | Wang | A47D 9/005 |
| 2005/0034232 | A1 * | 2/2005 | Martin | A47D 7/04 5/93.1 |
| 2006/0000019 | A1 * | 1/2006 | Martin | A47D 7/04 5/99.1 |
| 2007/0214576 | A1 * | 9/2007 | Espenshade | A47D 15/003 5/99.1 |
| 2007/0271697 | A1 * | 11/2007 | Martin | A47D 13/063 5/99.1 |
| 2008/0271243 | A1 | 11/2008 | Burkholder | |
| 2009/0077738 | A1 | 3/2009 | Burns | |
| 2009/0077739 | A1 * | 3/2009 | Mendes | A47D 7/04 5/93.1 |
| 2009/0077740 | A1 * | 3/2009 | Jackson | A47D 11/007 5/93.1 |
| 2009/0077741 | A1 * | 3/2009 | Burns | A47D 13/063 5/98.1 |
| 2009/0077742 | A1 * | 3/2009 | Burns | A47D 7/04 5/99.1 |
| 2009/0144896 | A1 | 6/2009 | Chen | |
| 2011/0258775 | A1 * | 10/2011 | Burkholder | A47D 7/00 5/98.3 |
| 2011/0283457 | A1 * | 11/2011 | Son | A47D 7/04 5/690 |
| 2013/0047336 | A1 * | 2/2013 | Burkholder | A47D 7/04 5/93.1 |
| 2014/0068856 | A1 * | 3/2014 | Thomson | A47D 7/00 5/93.1 |
| 2014/0165288 | A1 * | 6/2014 | Wang | A47D 9/005 5/99.1 |
| 2014/0208505 | A1 * | 7/2014 | Burkholder | A47D 7/002 5/99.1 |
| 2014/0345046 | A1 * | 11/2014 | Burkholder | A47D 9/00 5/98.1 |
| 2016/0242566 | A1 | 8/2016 | Tadipatri et al. | |
| 2018/0008056 | A1 | 1/2018 | Yang | |
| 2022/0225788 | A1 * | 7/2022 | Guo | A47D 7/002 |

FOREIGN PATENT DOCUMENTS

| | | | | |
|---|---|---|---|---|
| CN | 201370338 | Y | 12/2009 | |
| CN | 202858551 | U | 4/2013 | |
| CN | 205093999 | U | 3/2016 | |
| CN | 105996584 | A | 10/2016 | |
| CN | 205831535 | U | 12/2016 | |
| CN | 206381003 | U | 8/2017 | |
| CN | 207679216 | U | 8/2018 | |
| CN | 110074598 | A | 8/2019 | |
| DE | 102022100724 | A1 * | 7/2022 | A47D 7/002 |
| EP | 3199065 | A1 | 8/2017 | |
| TW | 198800 | U | 1/1993 | |

* cited by examiner

BABY HAMMOCK AND BABY CRIB

CROSS-REFERENCE TO RELATED APPLICATIONS

This application claims to the priority of Chinese Patent Application No. 2021100572617, filed on Jan. 15, 2021, the entire contents of which is incorporated herein by reference.

TECHNICAL FIELD

The present disclosure relates to a baby hammock and a baby crib.

BACKGROUND

Baby cribs provide great convenience for caregivers to take care of babies or infants. In order to expand the functions of the baby cribs, many baby cribs are equipped with baby hammocks. The baby hammocks are detachably disposed above the baby cribs, such that the caregivers can conveniently take out or place the babies or infants.

A conventional baby hammock generally includes a crib base, a peripheral crib fence extending upward from a peripheral edge of the crib base, and an annular frame connected to an upper edge of the peripheral crib fence. The annular frame may be supported on a crib support of the baby crib, such that the baby hammock can be accommodated in a space defined by the baby crib.

There are various known solutions having a foldable design of baby cribs facilitating storage and transport of baby cribs. However, the baby crib equipped with the above baby hammock still has a relatively large size after being folded.

SUMMARY

According to various embodiments, a baby hammock is provided including: a crib support; a first peripheral crib fence mounted to the crib support and having an opening at a bottom thereof; and a hammock portion, where a periphery of the hammock portion is detachably connected to the first peripheral crib fence by at least one first zipper, and the hammock portion covers the opening of the first peripheral crib fence.

A baby crib including the above baby hammock is also provided.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

To illustrate the technical solutions according to the embodiments of the present invention or in the prior art more clearly, the accompanying drawings for describing the embodiments or the prior art are introduced briefly in the following. Apparently, the accompanying drawings in the following description are only some embodiments of the present invention, and persons of ordinary skill in the art can derive other drawings from the accompanying drawings without creative efforts.

DETAILED DESCRIPTION OF THE EMBODIMENTS

Figure 1:
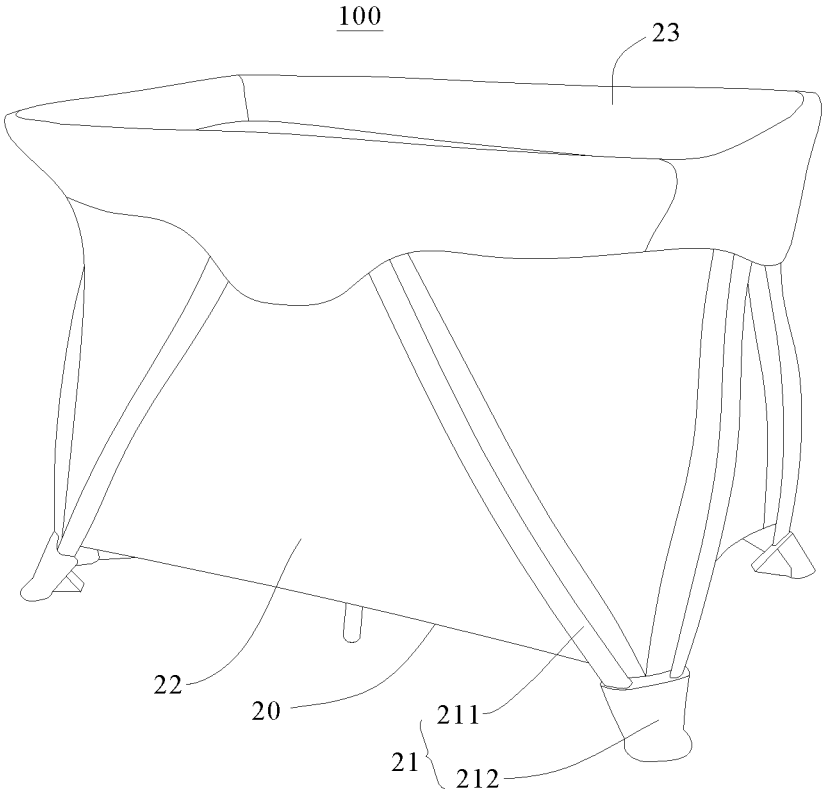
FIG. 1 is a schematic perspective view of a baby crib.

Embodiments of the invention are described more fully hereinafter with reference to the accompanying drawings. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art. Elements that are identified using the same or similar reference characters refer to the same or similar elements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element is referred to as being "connected" or "coupled" to another element, it can be directly connected or coupled to the other element or intervening elements may be present. In contrast, if an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 to FIG. 6 show schematic structures of a baby crib 100 according to some embodiments. The baby crib 100 has a baby hammock according to some embodiments.

Figure 2:
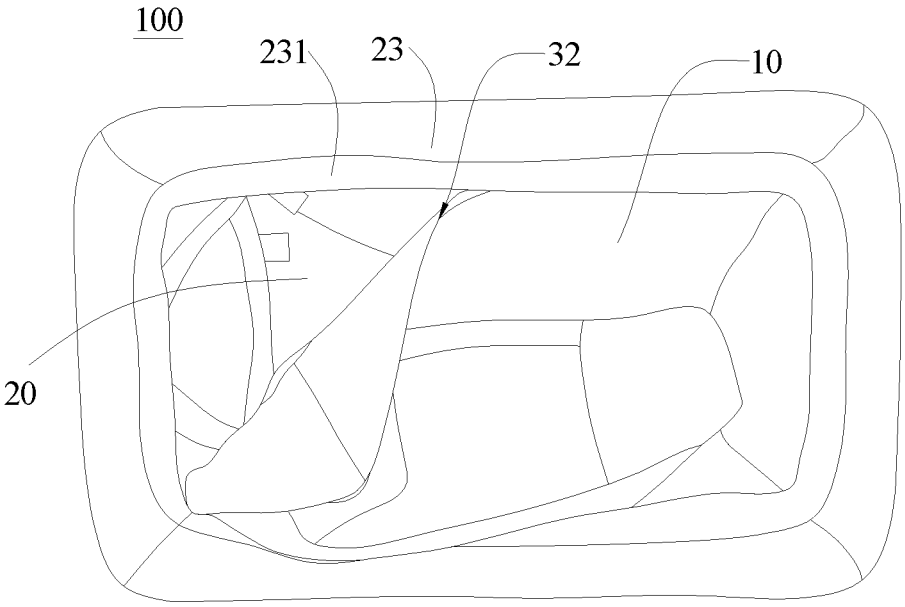
FIG. 2 is a schematic top view of the baby crib in FIG. 1.

As shown in FIG. 1 and FIG. 2, the baby crib 100 may include a crib support 21, a first peripheral crib fence 23, a second peripheral crib fence 22, a crib base 20, and a hammock portion 10. The crib support 21, the first peripheral crib fence 23, and the hammock portion 10 are also part of the baby hammock according to some embodiments.

The crib support 21 may include a support frame 211, a support foot 212 mounted to a bottom of the support frame 211, and other appropriate structures. A top end of the support frame 211 is surround by an armrest frame (not shown in FIG. 1, wrapped by a top of the first peripheral crib fence 23). It should be understood that, the crib support 21 may be a foldable crib support, which will not described in detail herein.

The second peripheral crib fence 22 is mounted to the crib support 21. The second peripheral crib fence 22 has a bottom opening that is covered by the crib base 20, so as to form a space for accommodating a baby. The space is, for example, an entertainment space applicable to activities of the baby. It should be understood that, the crib base 20 may completely or incompletely cover the bottom opening of the second peripheral crib fence 22. The second peripheral crib fence 22 and the crib base 20 may be made of fabrics, and are stitched together and mounted to the crib support 21. In some embodiments, the second peripheral crib fence 22 and the crib support 21 may be detachably mounted together.

The first peripheral crib fence 23 is mounted to the crib support 21. In this embodiment, a top portion of the first peripheral crib fence 23 wraps around the armrest frame on the top end of the crib support 21. In some embodiments, the first peripheral crib fence 23 and the second peripheral crib fence 22 may be an integral piece or stitched together, then they are fixed to or detachably mounted to the crib support 21. In some other embodiments, the first peripheral crib fence 23 may be mounted to the crib support 21 by other manners. For example, the first peripheral crib fence 23 and the second peripheral crib fence 22 are independent of each other, the first peripheral crib fence 23 is detachably connected to the crib support 21, and the second peripheral crib fence 22 is fixedly or detachably connected to the crib support 21. As such, the first peripheral crib fence 23 may be dissembled for replacement or cleaning, while the mounting of the second peripheral crib fence 22 to the crib support 21 is not affected, and the second peripheral crib fence 22 can still provide the entertainment space for the baby. The first peripheral crib fence 23 has an opening at a bottom thereof, and the opening is located in a space formed by the second peripheral crib fence 22.

Figure 3:
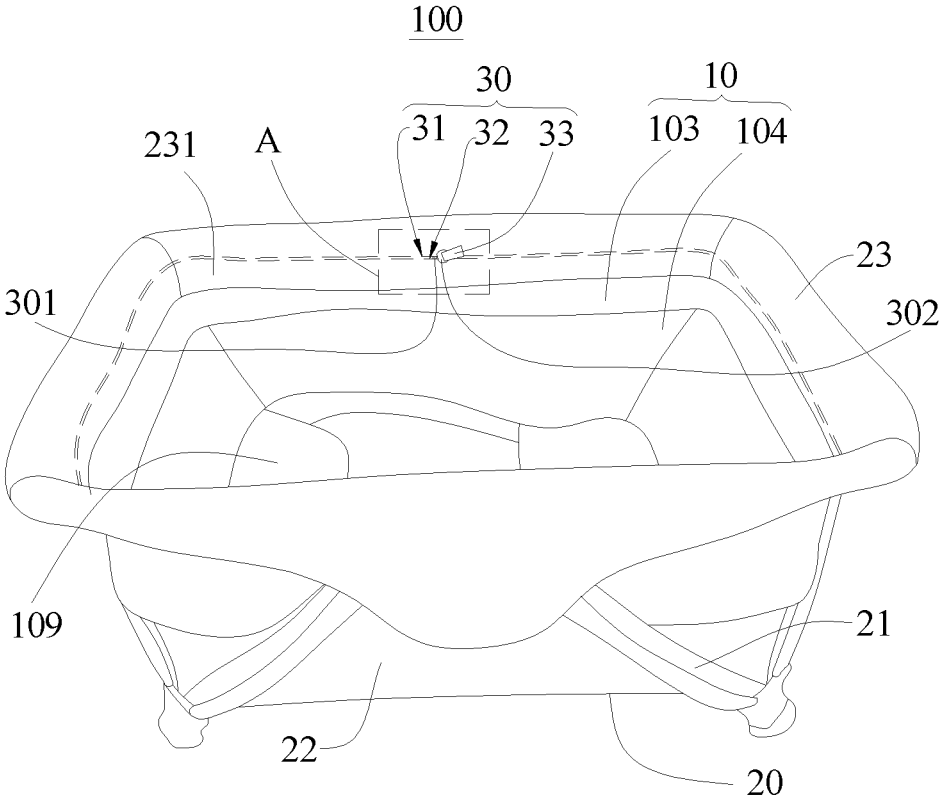
FIG. 3 is an another schematic perspective view of the baby crib in FIG. 1.

Referring to FIG. 3, a periphery of the hammock portion 10 is detachably connected to the first peripheral crib fence 23 by a first zipper 30 surrounding the first peripheral crib fence 23. A head end 301 (an end of the first zipper 30 at which zipping starts) is adjacent to a tail end 302 (an end of the first zipper 30 at which zipping ends). The first zipper 30 may include a first chain portion 31 and a second chain portion 32 docked together by a zipper head 33. In some embodiments, the first peripheral crib fence 23 and the hammock portion 10 may be made of woven fabric. The first chain portion 31 may be connected to the first peripheral crib fence 23, and the second chain portion 32 may be connected to the periphery of the hammock portion 10. The zipper head 33 is, for example, located on the second chain portion 32 and may be separated from the first chain portion 31. When the hammock portion 10 is connected to the first peripheral crib fence 23, the hammock portion 10 may completely or incompletely cover the opening of the first peripheral crib fence 23. In addition, the hammock portion 10 is located above the crib base 20, and the hammock portion 10 and the first peripheral crib fence 23 form a relatively small hammock space for the baby to lie down, such that a caregiver may conveniently take out or place babies or infants.

Referring to FIG. 3, in some embodiments, the hammock portion 10 includes a bottom 104 and a fence 103 extending upwards from the bottom 104, and an upper edge of the fence 103 serves as the periphery of the hammock portion 10 for mounting the first zipper 30. The second chain portion 32 is, for example, disposed on the upper edge of the fence 103. In some other embodiments, the fence 103 may be omitted. In that case, the hammock portion 10 may include the bottom 104 only, and an outer edge of the bottom 104 serves as the periphery of the hammock portion 10 for mounting the first zipper 30, while the second chain portion 32 is, for example, disposed on the outer edge of the bottom 104.

It should be noted that, although the first zipper 30 is disposed between the periphery of the hammock portion 10 and the first peripheral crib fence 23 in this embodiment, it should be understood that, the arrangement manner of the first zipper 30 is not limited thereto. For example, in other embodiments, the hammock portion 10 may be connected to the first peripheral crib fence 23 by a plurality of first zippers 30. The plurality of first zippers 30 are, for example, spaced from each other in a circumferential direction of the first peripheral crib fence 23. Therefore, when a part of one certain first zipper 30 is damaged, this first zipper 30 may be replaced without a need of replacing all of the first zippers 30. As such, the maintenance costs of the baby hammock are reduced.

According to the baby crib and the baby hammock provided in the above embodiments, the hammock portion 10 of the baby hammock is connected to the first peripheral crib fence 23 by the first zipper 30. The hammock portion 10 is simple in structure and easy to disassemble from the first peripheral crib fence 23 and fold, and occupies less space after being folded, thus facilitating storage and transport of the baby crib 100.

Figure 4:
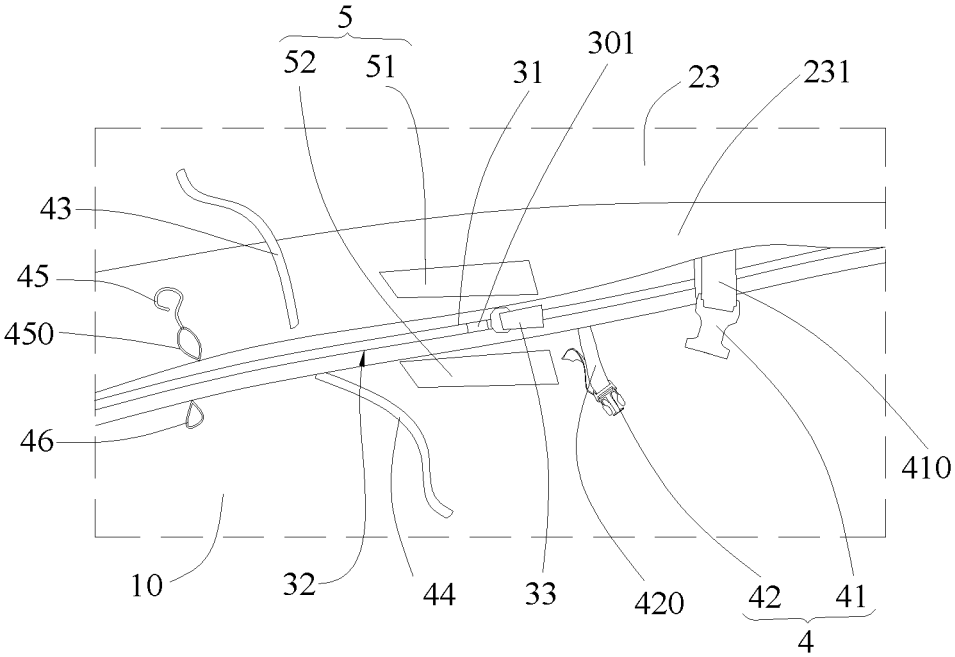
FIG. 4 is a partial schematic enlarged view of a portion A in FIG. 3.
Figure 5:
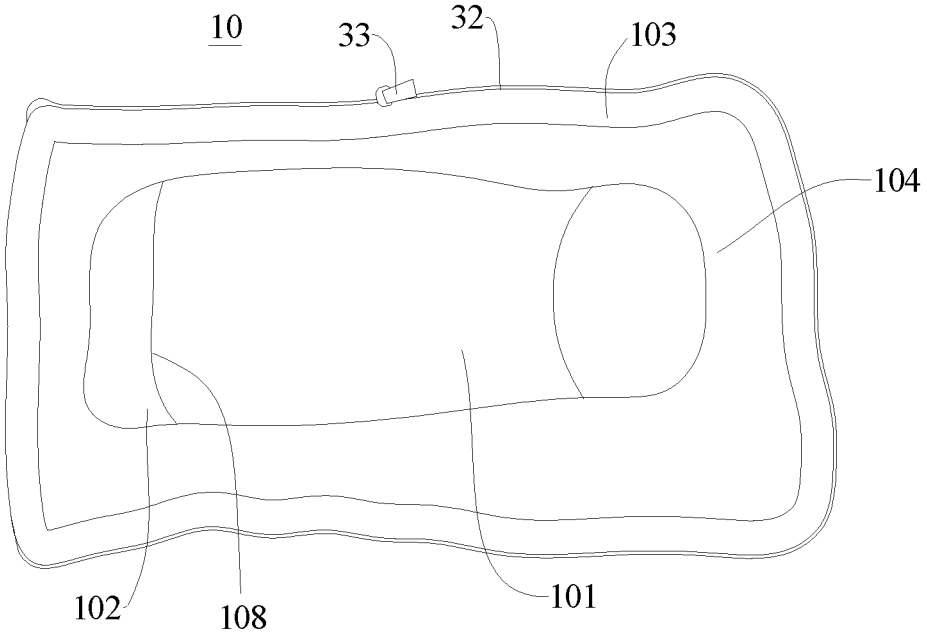
FIG. 5 is a schematic perspective view of a rear surface of a hammock portion in the baby hammock in FIG. 1.

Referring to FIG. 2 and FIG. 3, in some embodiments, a shielding edge 231 configured to shield the first zipper 30 may be further provided on the first peripheral crib fence 23. In this way, the first zipper 30 which is rough can be prevented from getting into contact with skins of babies or infants. Referring to FIG. 4, in order to avoid the shielding edge 231 from being turned up, the shielding edge 231 is connected to the hammock portion 10 by a first engagement structure 5. In some embodiments, the first engagement structure 5 may include a bonding structure, for example, may include a first adhesive strap 51 and a second adhesive strap 52 that are bonded together. The first adhesive strap 51 is, for example, disposed on the shielding edge 231. The second adhesive strap 52 is, for example, disposed on the fence 103 of the hammock portion 10. In other embodiments, the first engagement structure 5 may further be a snap-fastener structure, where male fastener and a female fastener of the snap-fastener structure are respectively connected to the shielding edge 231 and the fence 103.

Referring to FIG. 4, in some embodiments, in order to guarantee the reliability of the connection between the hammock portion 10 and the first peripheral crib fence 23, the hammock portion 10 may be further connected to the first peripheral crib fence 23 by a plurality of safety members 4. Each safety member 4 allows the hammock portion 10 to be separated from the first peripheral crib fence 23. In some embodiments, when the hammock portion 10 is connected to the first peripheral crib fence 23 and the first peripheral crib fence 23 is provided with the shielding edge 231, the safety members 4 may be shielded by the shielding edge 231.

For example, in some embodiments, the safety member 4 may include a first buckle 41 (a female buckle) and a second buckle 42 (a male buckle). The first buckle 41 is connected to the first peripheral crib fence 23 by a first webbing 410. The second buckle 42 is connected to the hammock portion 10 by a second webbing 420. The first buckle 41 and the second buckle 42 can be detachably buckled together.

In some embodiments, the safety member 4 may include a first tie 43 and a second tie 44. The first tie 43 is connected to the first peripheral crib fence 23. The second tie 44 is connected to the hammock portion 10. The first tie 43 and the second tie 44 can be tied together.

In some embodiments, the safety member 4 may include a hook 45 and a hooking strip 46. The hook 45 may be connected to one of the first peripheral crib fence 23 and the hammock portion 10 by a third webbing 450. The hooking strip 46 may be connected to the other one of the first peripheral crib fence 23 and the hammock portion 10. The hook 45 can be hooked with the hooking strip 46.

It should be understood that, the above implementations of the safety member 4 may or may not exist in the same baby hammock simultaneously. In addition, the implementation of the safety member 4 is not limit to the above examples, as long as double protection or multi-protection can be achieved for the connection between the hammock portion 10 and the first peripheral crib fence 23 by the mating of the safety member with the first zipper 30.

In order to enable the hammock portion 10 to support babies or infants more effectively, in some embodiments, the bottom 104 of the hammock portion 10 is provided with a first support structure 6. For example, referring to FIG. 5 and FIG. 6, in some embodiments, the first support structure 6 may include a first support plate 61. The first support plate 61 corresponds to an ideal lying region 109 (see FIG. 3) for babies and infants defined by the bottom 104 of the hammock portion 10. The first support plate 61 may be a hard support plate, or may be a soft support plate. A first accommodating bag 101 may be disposed on a rear surface (a surface facing the ground) of the bottom 104 of the hammock portion 10. The first support plate 61 is located in the first accommodating bag 101.

In some embodiments, the first accommodating bag 101 may be stitched to the rear surface of the bottom 104 of the hammock portion 10. The first accommodating bag 101 has a first bag opening 108 configured to place and take out the first support plate 61. The first bag opening 108 may be, for example, sealed by a second zipper (not shown). Alternatively, referring to FIG. 5, in some other embodiments, the first bag opening 108 may be sealed by a first flipping cover 102 connected to the bottom 104 of the hammock portion 10. The first flipping cover 102 is connected to the first accommodating bag 101 by a second engagement structure (not shown). The second engagement structure may be, for example, a zipper structure, a bonding structure, a snap-fastener structure, or the like.

Figure 6:
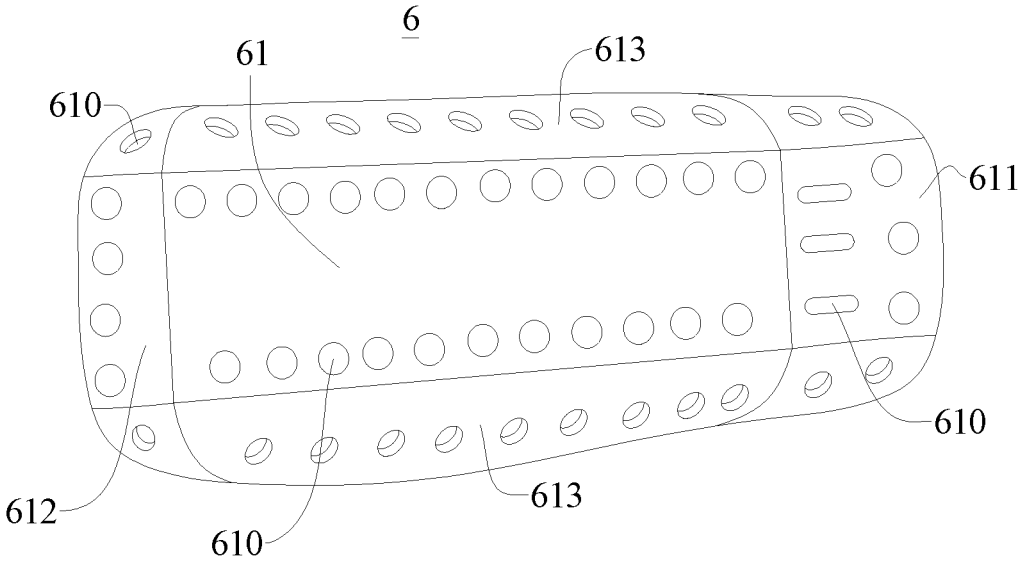
FIG. 6 is a schematic perspective view of a first support plate according to an embodiment.

In some embodiments, referring to FIG. 6, a plurality of vent holes 610 may be provided in the first support plate 61 to facilitate ventilation and reduce the weight of the first support plate 61. A width of a head portion 611 of the first support plate 61 is less than a width of a tail portion 612 of the first support plate. Left and right side edges 613 of the first support plate 61 are flipped upward, so as to support the babies or infants more effectively.

Figure 7:
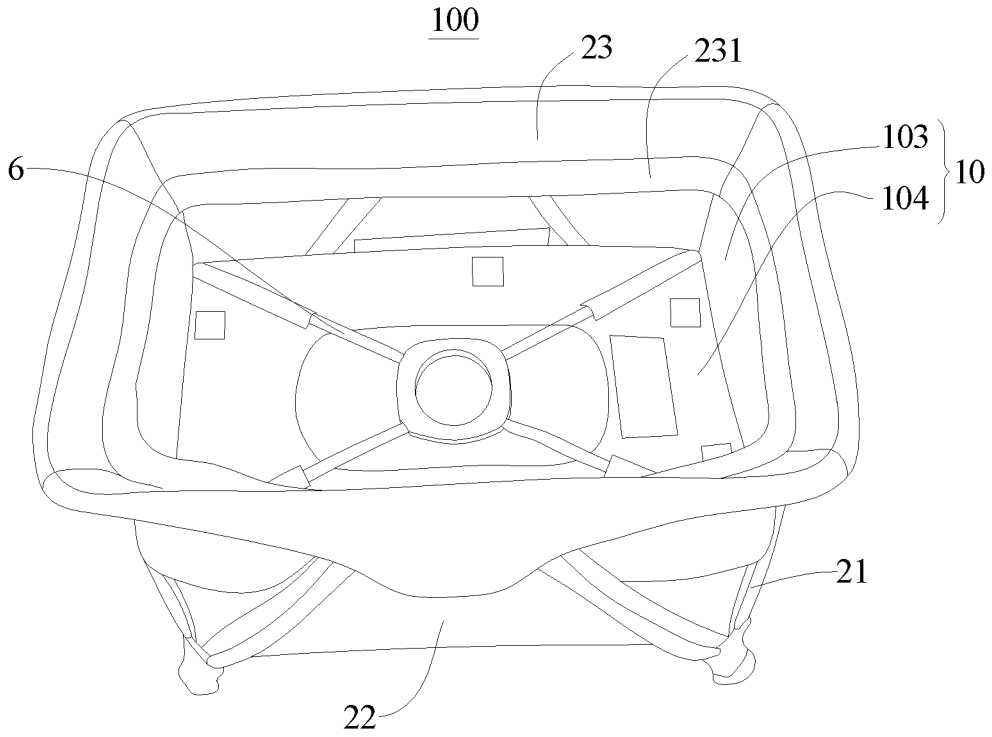
FIG. 7 is a schematic perspective view of a baby crib according to another embodiment.
Figure 8:
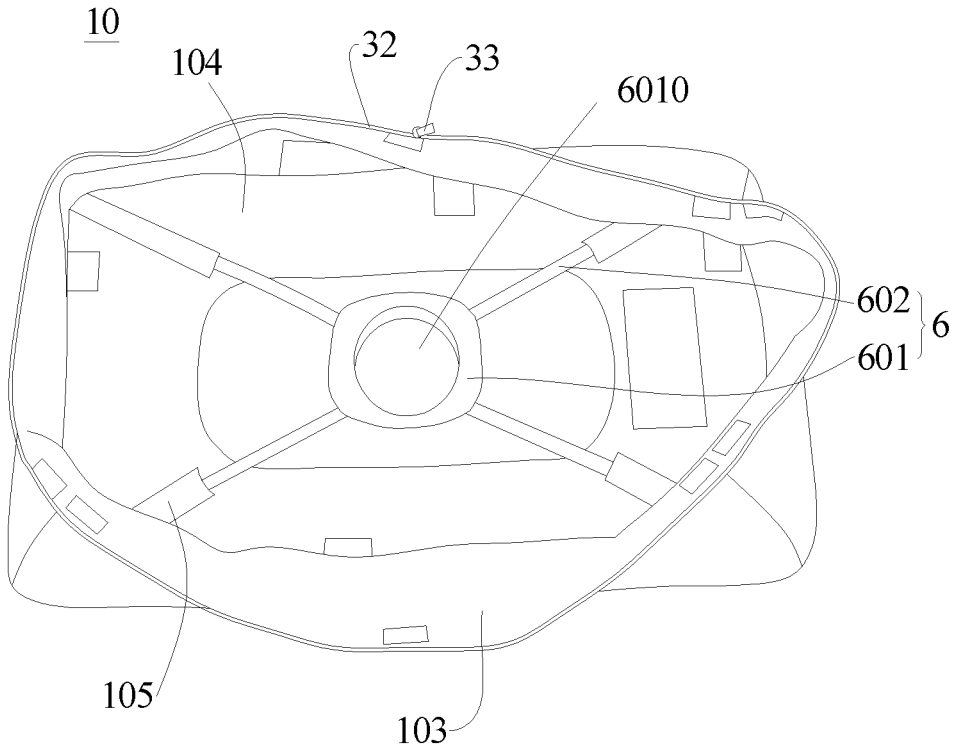
FIG. 8 is a schematic perspective view of the baby hammock in FIG. 7.
Figure 9:
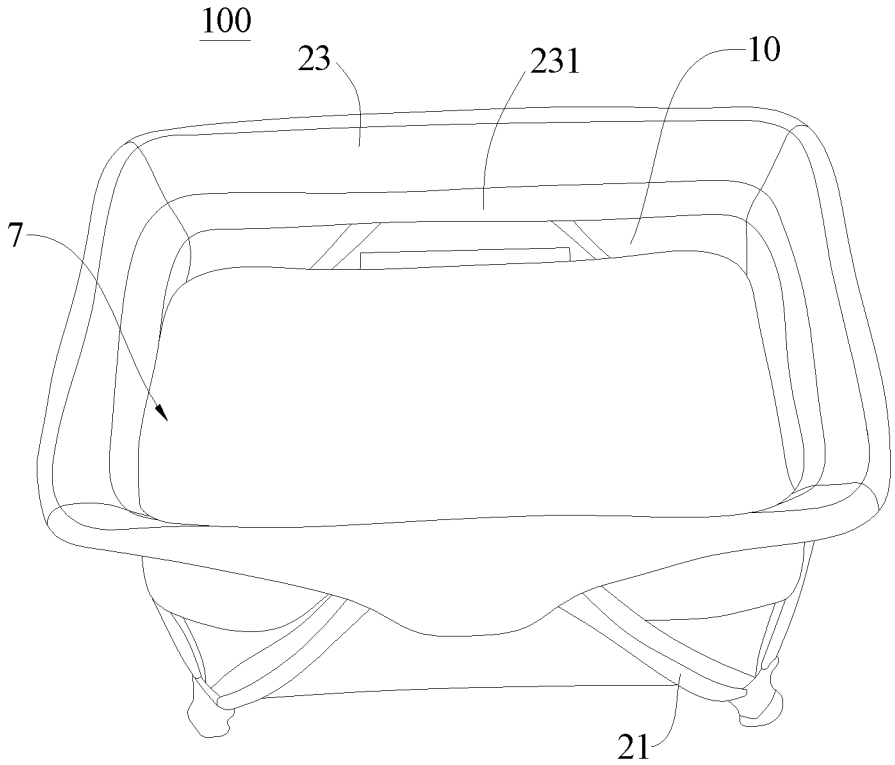
FIG. 9 is a schematic perspective view of the baby crib in FIG. 7.

FIG. 7 to FIG. 9 are schematic perspective views of another baby crib 100 according to some embodiments. The difference between the baby crib 100 and the baby crib 100 shown in FIG. 3 lies in an implementation of the first support structure 6 and a connection relationship between the first support structure and the hammock portion 10.

Referring to FIG. 8, the first support structure 6 may include a pivotal base 601 and a plurality of support arms 602. The plurality of support arms 602 are pivotally connected to the pivotal base 601 spokewise. The plurality of support arms 602 may be gathered together or separated relative to a center line of the pivotal base 601. In this embodiment, four support arms 602 are provided. In other embodiments, the number of the support arms 602 is not limited to four. The first support structure 6 is supported on a top surface (a surface facing the sky) of the bottom 104 of the hammock portion 10. A plurality of sleeve bags 105 for inserting the plurality of support arms 602 are disposed on the top surface of the bottom 104 of the hammock portion 10, so as to fix relative positions of the first support structure 6 and the bottom 104. In some embodiments, the pivotal base 601 may have a center hole 6010. A user can conveniently remove the first support structure 6 from the bottom 104 through the center hole 6010.

In some embodiments, referring to FIG. 9, a first mattress 7 may be further disposed in the baby crib 100. The first mattress 7 lies on the first support structure 6. In addition, in order to fix relative positions of the first mattress 7 and the bottom 104 of the hammock portion 10, the first mattress 7 is connected to the top surface of the bottom 104 of the hammock portion 10 by a third engagement structure (not shown). The third engagement structure is, for example, a bonding structure.

Figure 10:
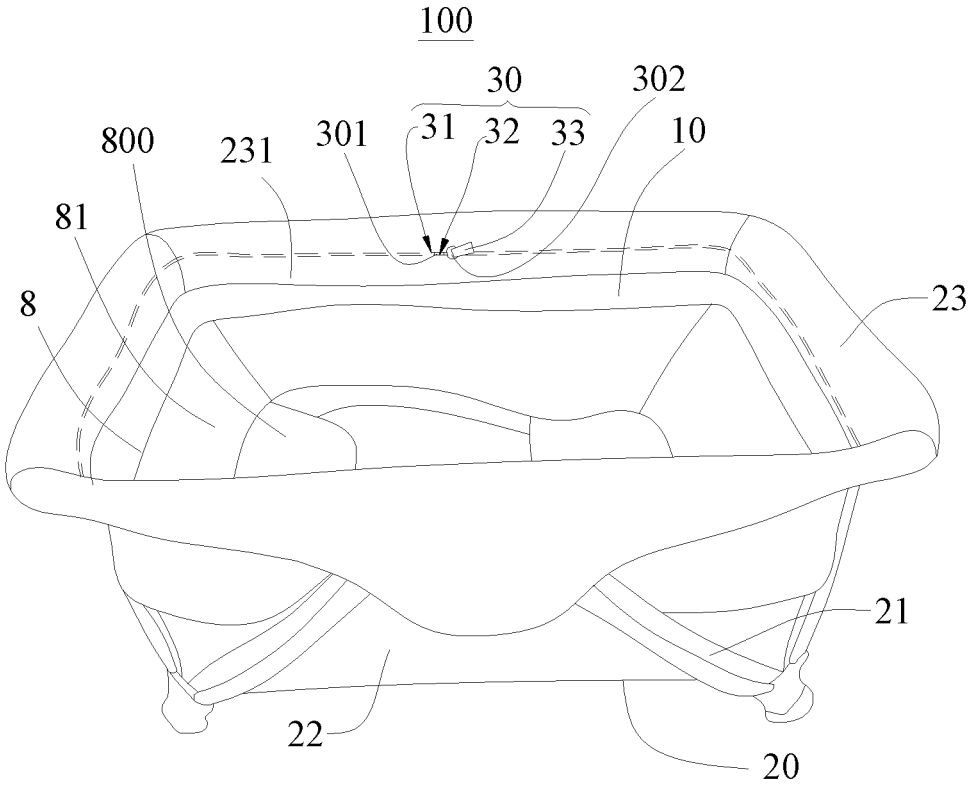
FIG. 10 is a schematic perspective view of a baby crib according to another embodiment.
Figure 11:
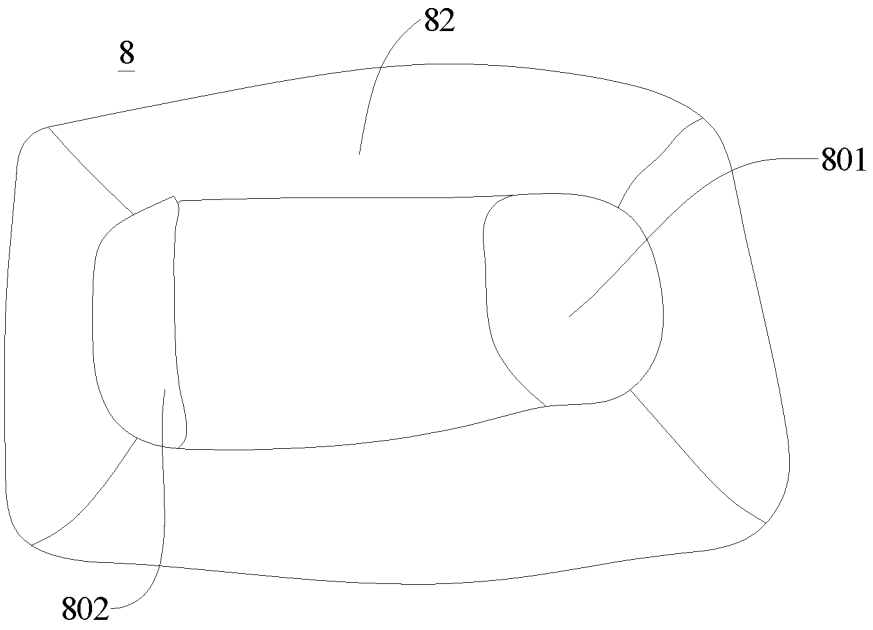
FIG. 11 schematically shows a bottom surface of the second mattress in FIG. 10.
Figure 12:
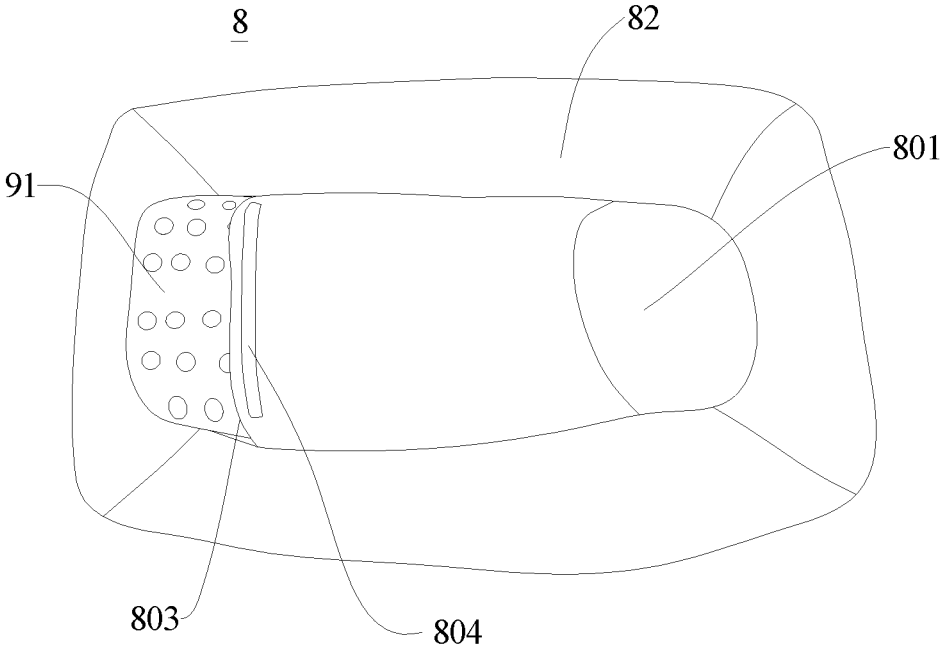
FIG. 12 is a schematic top view of a second support plate mounted to the mattress in FIG. 10.

FIG. 10 to FIG. 12 are schematic perspective views of another baby crib 100 according to some embodiments. The difference between the baby crib 100 and the baby crib 100 shown in FIG. 3 lies in that the first support structure 6 may be not disposed at the bottom of the hammock portion 10, instead, a second mattress 8 is provided on the top surface of the bottom of the hammock portion 10.

A second support structure may be disposed in the second mattress 8. In some embodiments, the second support structure may include a second support plate 91. The second support plate 91 corresponds to an ideal laying region 800 for babies or infants on a top surface 81 (a surface facing the sky) of the second mattress 8. For example, a second accommodating bag 801 may be disposed on a bottom surface 82 (a surface facing the ground) of the second mattress 8. The second support plate 91 is located in the second accommodating bag 801. In some embodiments, the structure of the second support plate 91 may be substantially the same as the structure of the first support plate 61 described above.

Referring to FIG. 11 and FIG. 12, the second accommodating bag 801 may be stitched to the bottom surface 82 of the second mattress 8. The second accommodating bag 801 has a second bag opening 803 for placing and taking the second support plate 91 out. In some embodiments, the second bag opening 803 is sealed by a third zipper (not shown). Alternatively, in some embodiments, the second bag opening 803 is sealed by a second flipping cover 802 connected to the bottom surface 82 of the second mattress 8. The second flipping cover 802 is connected to the second accommodating bag 801 by a third engagement structure 804. In some embodiments, the third engagement structure 804 may be a bonding structure or a snap-fastener structure. In order to fix relative positions of the second mattress 8 and the bottom of the hammock portion 10, the second mattress 8 is connected to the top surface of the bottom of the hammock portion 10 by, for example, a bonding structure.

Figure 13:
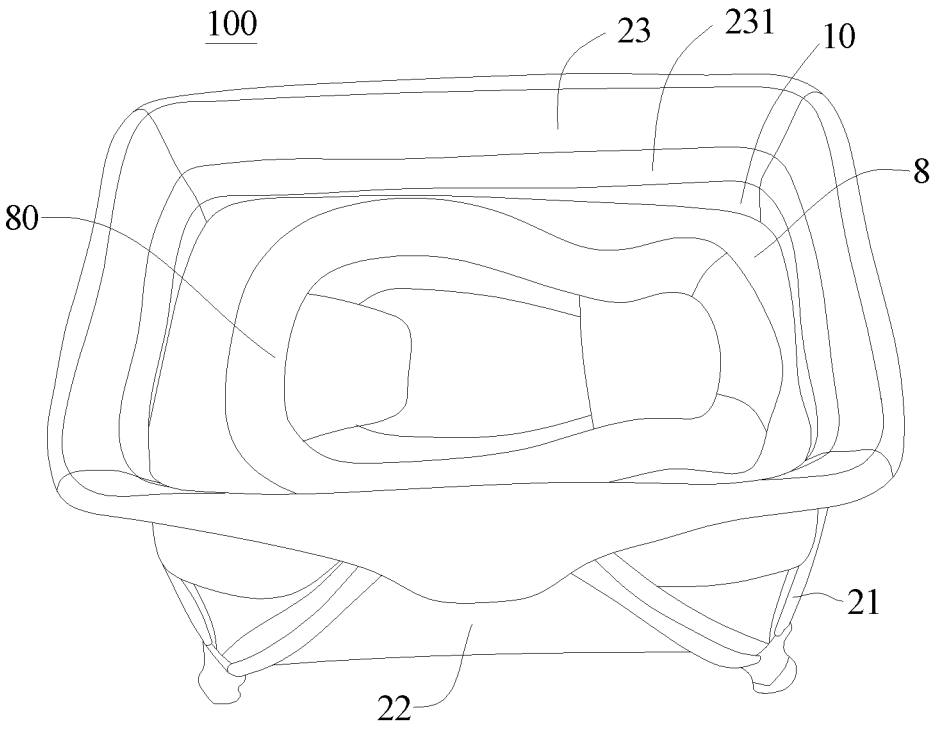
FIG. 13 is a schematic perspective view of a baby crib according to yet another embodiment.
Figure 14:
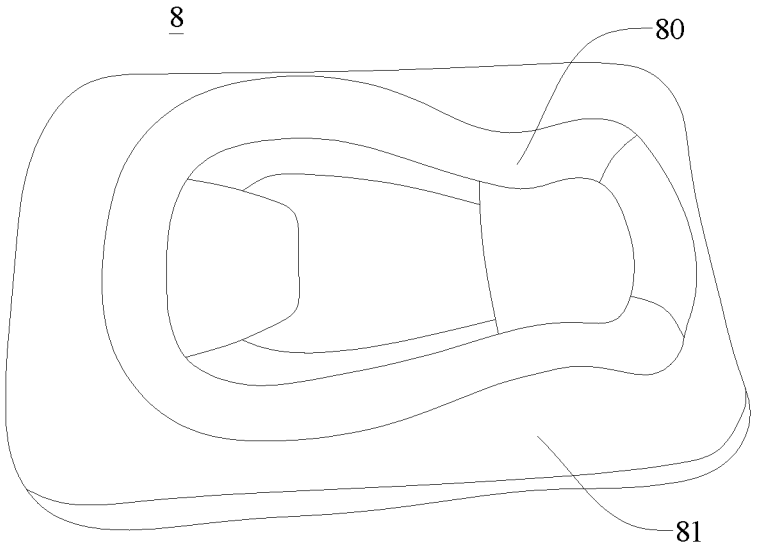
FIG. 14 schematically shows a top surface of the second mattress in FIG. 13.
Figure 15:
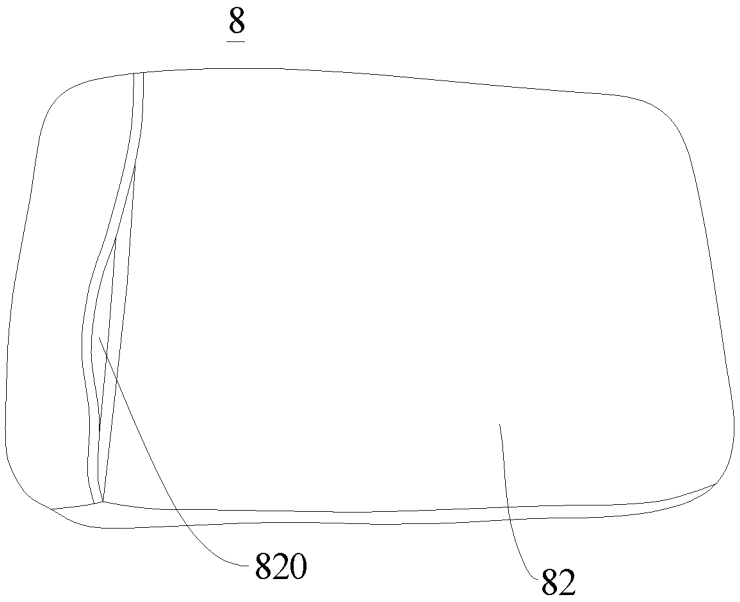
FIG. 15 schematically shows a bottom surface of the second mattress in FIG. 13.

FIG. 13 to FIG. 15 are schematic perspective views of another baby crib 100 according to some embodiments. The difference between the baby crib 100 and the baby crib 100 shown in FIG. 10 lies in the structure of the second mattress 8. In addition, the structure of the second support structure may be different.

Referring to FIG. 14, the top surface 81 of the second mattress 8 may include an accommodating portion 80. The accommodating portion 80 can accommodate the second support structure (not shown). When the second support structure is accommodated in the accommodating portion 80, the accommodating portion 80 protrudes out of the top surface 81, such that an ideal lying region for the babies or infants can be defined.

In some embodiments, the second support structure may be a third support plate. The third support plate may be manufactured into any appropriate shape according to design requirements. The third support plate may be a hard support plate or a soft support plate. Of course, the implementation of the second support structure is not limited to the third support plate.

Referring to FIG. 15, in some embodiments, the bottom surface 82 of the second mattress 8 has an opening 820. The second support structure may be mounted in the second mattress 8 through the opening 820. The opening 820 may be sealed by a zipper structure, a bonding structure, a snap-fastener structure, or the like. In addition, appropriate fillers such as detachable soft foam may be further filled in the second mattress 8 through the opening 820.

Although the respective embodiments have been described one by one, it shall be appreciated that the respective embodiments will not be isolated. Those skilled in the art can apparently appreciate upon reading the disclosure of this application that the respective technical features involved in the respective embodiments can be combined arbitrarily between the respective embodiments as long as they have no collision with each other. For example, the second mattresses 8 in FIG. 11 and FIG. 14 may be placed on the hammock portion 10 in FIG. 7. Of course, the respective technical features mentioned in the same embodiment can also be combined arbitrarily as long as they have no collision with each other.

The foregoing descriptions are merely specific embodiments of the present invention, but are not intended to limit the protection scope of the present invention. Any variation or replacement readily figured out by a person skilled in the art within the technical scope disclosed in the present invention shall all fall within the protection scope of the present invention. Therefore, the protection scope of the present invention shall be subject to the protection scope of the appended claims.

What is claimed is:

1. A baby hammock, comprising:
a crib support;
a first peripheral crib fence mounted to the crib support and having an opening at a bottom thereof; and
a hammock portion, wherein
a periphery of the hammock portion is detachably connected to the first peripheral crib fence by at least one first zipper,
the hammock portion covers the opening of the first peripheral crib fence, and
the hammock portion is provided with a first support structure at a bottom thereof, the first support structure comprises a first support plate having a plurality of vent holes.

2. The baby hammock according to claim 1, wherein the at least one first zipper is circumferentially disposed on the first peripheral crib fence, and a head end of the at least one first zipper is adjacent to a tail end of the at least one first zipper.

3. The baby hammock according to claim 1, wherein the periphery of the hammock portion is connected to the first peripheral crib fence by a plurality of the at least one first zipper, and the plurality of said first zippers are spaced apart from each other in a circumferential direction.

4. The baby hammock according to claim 1, further comprising a plurality of safety members, wherein each safety member is connected to the hammock portion and the first peripheral crib fence, and enables the hammock portion to be separated from the first peripheral crib fence.

5. The baby hammock according to claim 1, wherein the first peripheral crib fence is provided with a shielding edge configured to shield the at least one first zipper.

6. The baby hammock according to claim 5, wherein the shielding edge is connected to the hammock portion by a first engagement structure.

7. The baby hammock according to claim 6, wherein the first engagement structure is at least one of a bonding structure and a snap-fastener structure.

8. The baby hammock according to claim 4, wherein each safety member comprises:
a first buckle connected to the first peripheral crib fence by a first webbing; and
a second buckle connected to the hammock portion by a second webbing,
wherein the first buckle and the second buckle are detachably buckled together.

9. The baby hammock according to claim 4, wherein each safety member comprises:
a first tie connected to the first peripheral crib fence; and
a second tie connected to the hammock portion, wherein the first tie and the second tie are tied together.

10. The baby hammock according to claim wherein each safety member comprises:
a hook connected to one of the first peripheral crib fence and the hammock portion by a third webbing; and
a hooking strip connected to the other one of the first peripheral crib fence and the hammock portion, wherein the hook is hooked with the hooking strip.

11. The baby hammock according to claim 1, wherein the hammock portion is provided with a first accommodating bag on a rear surface of a bottom thereof, and the first support plate is located in the first accommodating bag.

12. The baby hammock according to claim 11, wherein the first accommodating bag is stitched to the rear surface of the bottom of the hammock portion, and the first accommodating bag has a first bag opening for placing or taking the first support plate out.

13. The baby hammock according to claim 1, wherein the first support structure comprises:
a pivotal base; and
a plurality of support arms pivotally connected to the pivotal base spokewise,
wherein the first support structure is located on a top surface of the bottom of the hammock portion, a plurality of sleeve bags are provided on the top surface of the bottom of the hammock portion, and the plurality of support arms are inserted in the plurality of sleeve bags, respectively.

14. The baby hammock according to claim 13, wherein the pivotal base has a center hole.

15. The baby hammock according to claim 11, further comprising a first mattress laid on the first support structure.

16. The baby hammock according to claim 15, wherein the first mattress is connected to the top surface of the bottom of the hammock portion by an engagement structure.

17. The baby hammock according to claim 15, further comprising a second mattress laid on a top surface of the bottom of the hammock portion, wherein a second support structure is disposed in the second mattress.

18. The baby hammock according to claim 17, wherein the second support structure comprises a second support plate, the second mattress is provided with a second accommodating bag on a bottom surface thereof, and the second support plate is located in the second accommodating bag.

19. The baby hammock according to claim 18, wherein the second accommodating bag is stitched to the bottom surface of the second mattress, and the second accommodating bag has a second bag opening for placing and taking the second support plate out.

20. The baby hammock according to claim 19, wherein the second bag opening is sealed by a zipper; or the second bag opening is sealed by a second flipping cover connected to the bottom surface of the second mattress, wherein the second flipping cover is connected to the accommodating bag by the third an engagement structure.

21. The baby hammock according to claim 1, wherein the crib support is a foldable crib support.

22. A baby crib, comprising the baby hammock according to claim 1.

23. The baby crib according to claim 22, further comprising:

a crib base; and a second peripheral crib fence mounted to the crib support, wherein a bottom of the second peripheral crib fence is covered by the crib base, the second peripheral crib fence surrounds the hammock portion, and the crib base is located below the hammock portion.

24. A baby hammock, comprising:

a crib support;

a first peripheral crib fence mounted to the crib support and having an opening at a bottom thereof; and a hammock portion, wherein a periphery of the hammock portion is detachably connected to the first peripheral crib fence by at least one first zipper, the hammock portion covers the opening of the first peripheral crib fence, and the hammock portion is provided with a first support structure at a bottom thereof, the first support structure comprises a first support plate, a width of a head portion of the first support plate is less than a width of a tail portion of the first support plate, and both side edges of the first support plate are flipped upward.

25. A baby hammock, comprising:

a crib support;

a first peripheral crib fence mounted to the crib support and having an opening at a bottom thereof; and a hammock portion, wherein a periphery of the hammock portion is detachably connected to the first peripheral crib fence by at least one first zipper, the hammock portion covers the opening of the first peripheral crib fence, the hammock portion is provided with a first support structure at a bottom thereof, the first support structure comprises a first support plate, the hammock portion is provided with a first accommodating bag, the first support plate is located in the first accommodating bag, the first accommodating bag is stitched to the rear surface of the bottom of the hammock portion, and the first accommodating bag has a first bag opening for placing or taking the first support plate out, and the first bag opening is sealed by a zipper; or the first bag opening is sealed by a first flipping cover connected to the bottom of the hammock portion, and the first flipping cover is connected to the first accommodating bag by an engagement structure.

26. A baby hammock, comprising:

a crib support;

a first peripheral crib fence mounted to the crib support and having an opening at a bottom thereof;

a hammock portion, wherein a periphery of the hammock portion is detachably connected to the first peripheral crib fence by at least one first zipper, and the hammock portion covers the opening of the first peripheral crib fence, a mattress laid on a top surface of the bottom of the hammock portion, and a support structure is disposed in the mattress, wherein the mattress comprises an accommodating portion on a top surface thereof matching a shape of the support structure, and when the support structure is located in the accommodating portion, the accommodating portion protrudes upwards from the top surface.

27. The baby hammock according to claim 26, wherein a bottom surface of the mattress has an opening configured to mount the support structure.

* * * * *